United States Patent [19]

Agbay

[11] Patent Number: 4,712,395

[45] Date of Patent: Dec. 15, 1987

[54] BARREL LOCK WITH DETERRENT RING AND KEY THEREFOR

[75] Inventor: Anthony J. Agbay, Auburn, Mass.

[73] Assignee: OMCO, Inc., Holden, Mass.

[21] Appl. No.: 945,232

[22] Filed: Dec. 23, 1986

Related U.S. Application Data

[63] Continuation of Ser. No. 842,074, Mar. 19, 1986, abandoned, which is a continuation of Ser. No. 595,434, Mar. 30, 1984, abandoned.

[51] Int. Cl.[4] ..... E05B 67/36

[52] U.S. Cl. ..... 70/34; 70/398

[58] Field of Search ..... 70/32, 33, 34, 386, 70/397, 398, 399, 402, 403, 404, 409

[56] References Cited

U.S. PATENT DOCUMENTS

| | | | |
|---|---|---|---|
| 4,058,992 | 11/1977 | Nielsen | 70/38 |
| 4,155,232 | 5/1979 | Haus | 70/34 |
| 4,252,006 | 2/1981 | Swisher | 70/386 |
| 4,289,000 | 9/1981 | Nielsen | 70/34 |
| 4,426,860 | 1/1984 | Swisher | 70/34 |

*Primary Examiner*—Robert L. Wolfe

*Attorney, Agent, or Firm*—Samuels, Gauthier, Stevens & Kehoe

[57] ABSTRACT

A barrel lock and a key for locking and unlocking the barrel lock. The lock has a hollow barrel with a plunger that reciprocates within the bore of the barrel. The plunger is urged forwardly by a bottom spring, and a deterrent ring is urged forwardly against the plunger by a top spring. The plunger has a shallow axial blind bore at its rear end and the deterrent ring has a central aperture, the diameter of the plunger bore being larger than the diameter of the ring aperture.

The key has four elongated outer expanding fingers and an inner expander rod. The expanding fingers are sized and shaped so that they can pass entirely through the central aperture of the deterrent ring. When the the key is inserted into the barrel lock and the key handle is operated, the fingers radially expand and grip the inner surface of the lock plunger blind bore. As the handle is operated further, the expanding fingers longitudinally retract and draw the plunger rearwardly permitting the lock to unlock. If an unauthorized key or nail is inserted into the barrel lock, the bottom spring holds the plunger in its forward locking position as the unauthorized key or nail pulls the deterrent ring rearwardly, preventing the lock from unlocking.

8 Claims, 5 Drawing Figures

BARREL LOCK WITH DETERRENT RING AND KEY THEREFOR

This is a continuation of co-pending application Ser. No. 842,074, filed on Mar. 19, 1986, and now abandoned, which is a continuation of application Ser. No. 595,434, filed Mar. 30, 1984, now abandoned.

BACKGROUND OF THE INVENTION

Prior art barrel locks and keys are shown in U.S. Pat. Nos. 1,923,025; 3,002,368; 3,835,674; and 4,289,000. The disclosures of these patents are incorporated by reference and made a part of the present disclosure. These prior art locks and keys have become increasingly less secure with the passage of time because of the relatively wide, albeit substantially controlled, distribution and use of the keys by a large number of people.

It is the object of this invention to provide a barrel lock which cannot be opened with a conventional key or with picks or nails.

It is also the object of this invention to provide a barrel lock key which is uniquely designed to open the aforesaid barrel lock.

SUMMARY OF THE INVENTION

A barrel lock and a key for locking and unlocking the barrel lock. The barrel lock has a hollow barrel with a plunger that reciprocates within the bore of the barrel. The plunger is biased forwardly by a bottom spring, and a deterrent ring is biased forwardly against the plunger by a top spring. The plunger has a shallow axial blind bore at its rear end for retracting the plunger from its forward locking position, and the deterrent ring has a central aperture whose diameter is smaller than the diameter of the plunger axial bore to limit access to the axial blind bore. The deterent ring, in cooperation with the bottom spring, prevents unauthorized retracting of the plunger from its locking position.

The key of this invention is specifically designed to open the barrel lock of this invention. It is somewhat similar to the prior art keys. However, the key has an inner expander rod and four elongated outer expanding fingers which are sized and shaped to fit through the aperture in the deterrent ring and to draw the lock plunger rearwardly when the key handle is operated. When the key is inserted into the lock, the expanding fingers pass through the deterrent ring aperture and are positioned within the bore in the lock plunger. When the key handle is operated, the fingers spread radially and tightly grip the inner surface of the axial bore. Further operation of the key handle retracts the lock plunger and permits the locking balls in the barrel lock to move radially inward to their unlocking position.

When an unauthorized key is inserted into the barrel lock, the deterrent ring and cooperating bottom spring prevent the key from retracting the plunger to its unlocking position. The small diameter of the deterrent ring central aperture either prevents the key's fingers from entering the plunger bore or, if the fingers pass into the plunger bore, the expanding fingers engage the deterrent ring and retract only the ring, the bottom spring holding the plunger in its forward locking position.

DESCRIPTION OF THE PREFERRED EMBODIMENT

Figure 1:
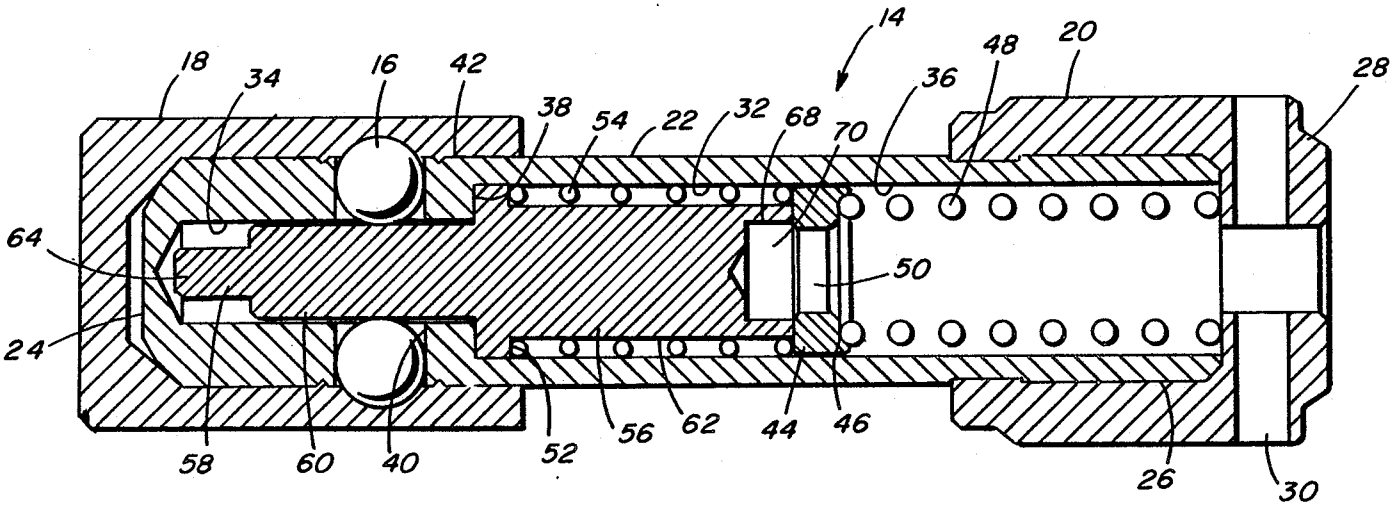
FIG. 1 is a vertical section showing the lock of this invention.

FIG. 1 shows a barrel lock 14 of this invention in its locked condition wherein its two locking members 16, for example locking balls, have been forced radially outward so that they engage in a groove in a front end cap 18. When barrel lock 14 is in its FIG. 1 locked condition, it cannot be longitudinally removed from front end cap 18.

Barrel lock 14 can be used in many situations to lock two elements against various types of relative movement. Front end cap 18 illustrates but one locking situation of the type wherein two unshown apertured flat panels have the lock inserted through both and the two flat panels are prevented from separating by the large rear end cap 20 of the lock on one side and the large front end cap 18 on the other side. There are many other situations in which barrel lock 14 is useful.

Barrel lock 14 has a hollow cylindrical lock barrel 22 which has a closed front end 24 and an open rear end 26. Rear end cap 20 is fitted over and fixed to open rear end 26 enlarging its effective outer diameter and creating an apertured rear end 28 with selected aperture size. A transverse passage 30 is also provided to accommodate a conventional "tell tale" or lead seal used to signal tampering.

The lock barrel 22 has a stepped axially extending bore 32 including a front small diameter bore 34 and a rear large diameter bore 36. The diameters are small and large relative to each other. The front bore 34 is joined to the rear bore 36 by an annular shoulder 38, the surface of which extends at an angle to the axis of the barrel bore 32. As will be seen, the function of annular shoulder 38 is to act as a plunger stop.

The lock barrel 22 also has two radially extending passageways 40 which run from the exterior surface 42 of barrel 22 to the front bore 34 of the barrel. The locking balls 16, for example steel locking balls, are movably mounted in the passageways and are free to move radially within the passageways. At the outer aperture of each passageway, a very small inwardly extending peripheral rim is provided which prevents the locking ball from completely escaping outwardly. However, almost half of the locking ball can project outwardly from the passageway as can be seen from FIG. 1.

A deterrent ring 44 is sized and shaped to fit within the rear bore 36 of the barrel. Deterrent ring 44 is positioned against the rear end of a cylindrical lock plunger 56. A top compression spring 48 is seated in a groove 46 in the rear end of deterrent ring 44 and urges the deterrent ring towards the front of the lock 14 and against the plunger 56. The deterrent ring 44 has a central opening 50 which may, for example, be a substantially circular opening. As will be subsequently seen, deterrent ring 44 prevents an unauthorized key from unlocking barrel lock 14.

Cylindrical lock plunger 56 is sized, shaped and mounted to reciprocate within the stepped barrel bore 32. The front exterior portion 58 of lock plunger 56 is sized to permit the locking balls 16 to move radially inward to their unlocking position. The middle exterior portion 60 of lock plunger slidably fits within the front bore 34 of the barrel 22 and is sized to force the locking balls 16 radially outward to their locking position. The rear exterior portion 62 slidably fits within the rear bore 36 of the barrel 22 and is stepped inwardly to form a shoulder 52 against which a bottom spring 54 rests. The plunger's forward movement is limited by the annular shoulder 38 of barrel bore 32 as shown in FIG. 1. Top compression spring 48 continuously urges deterrent ring 44 forwardly against lock plunger 56, the bottom compression spring 54 also continuously urging the lock plunger forwardly. Top compression spring 48 and bottom compression spring 54 normally are in partially compressed states.

Figure 2:
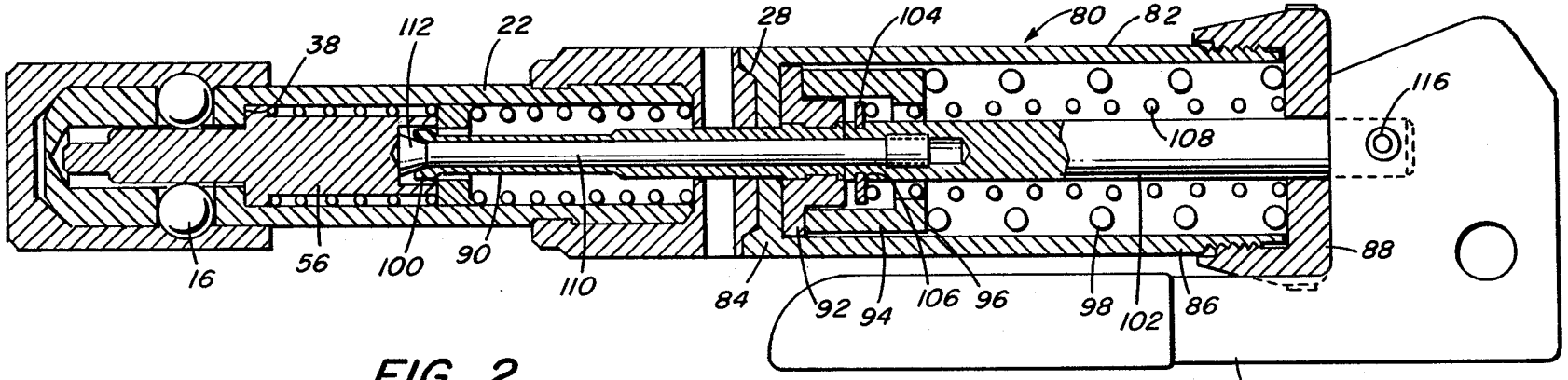
FIG. 2 is a vertical section showing both the lock of FIG. 1 and the key of this invention. The lock is shown in its locked condition with the key of this inventio shown inserted into the barrel lock and with the key handle shown in its first position.
Figure 3:
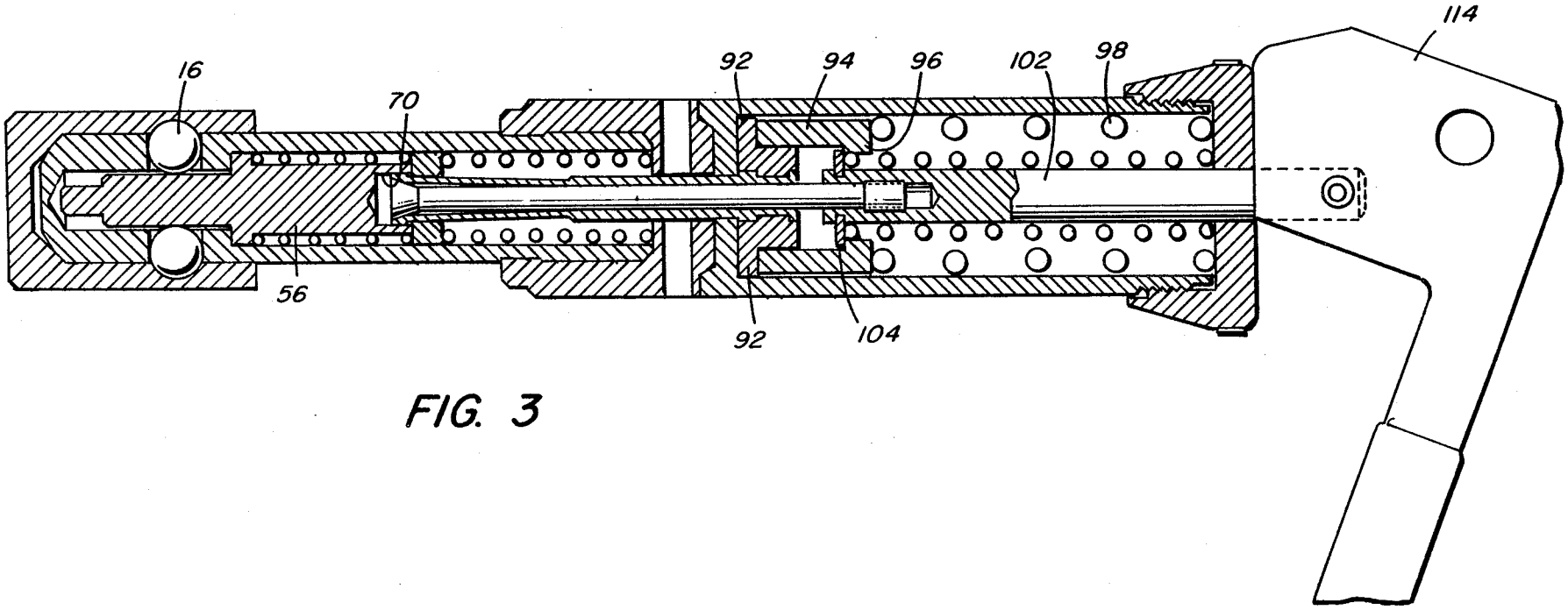
FIG. 3 is similar to FIG. 2 except that the key handle has been pivoted to its second position causing the key's expanding fingers to radially spread and grip the interior surface of the axial bore in the lock plunger.

The middle exterior portion 60 of the lock plunger 56 moves forwardly across and closes the inner apertures of both locking ball passageways 40 when the lock is in its locked condition as shown in FIGS. 1–3. The lock plunger 56 forces both locking balls 16 radially outward to their locking position whenever the middle portion 60 of the lock plunger covers the locking ball passageways 40. However, when the lock plunger 56 moves rearwardly and front portio 58 is aligned with the passageways 40, the locking balls move radially inward to their unlocking position as shown in FIG. 4.

The lock plunger 56 has a closed front end 64, an open rear end 68 and an axially extending blind bore 70. The diameter of the blind bore 70 is larger than the diameter of aperture 50 in deterrent ring 44. As will be subsequently seen, the inner surface of blind bore 70 has the function of acting as a gripping surface, and the small diameter deterrent ring 44 either prevents the fingers of an unauthorized key from entering the blind bore, or, if the fingers enter the blind bore, allows the expanding fingers to engage only the deterrent ring and not the gripping surface of the blind bore.

Figure 4:
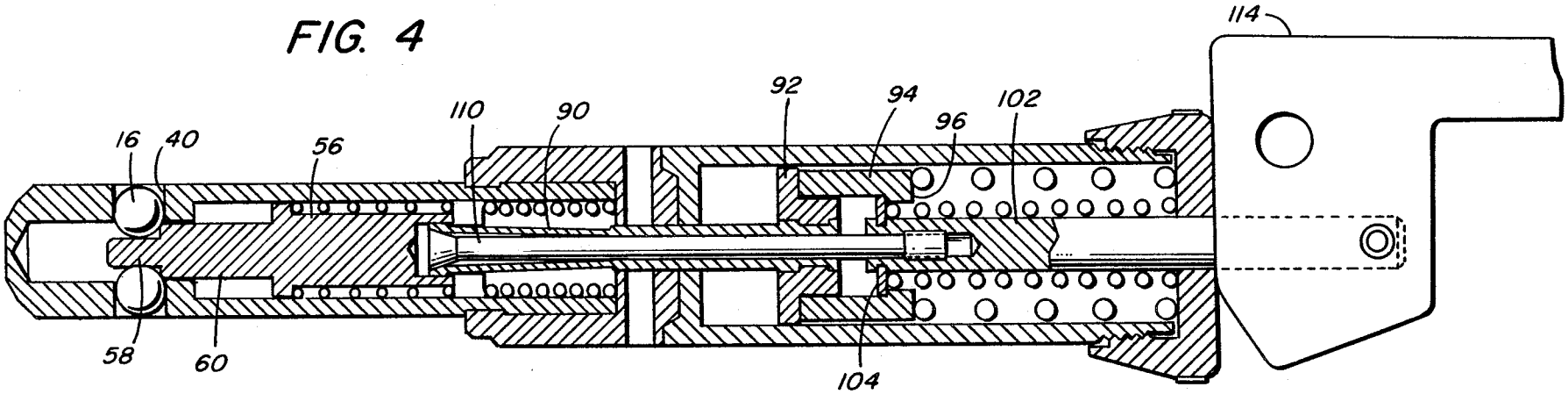
FIG. 4 is similar to FIG. 3 except that the key handle has been pivoted to its final position causing the lock plunger to retract fully, the lock plunger clearing the locking passageway inner apertures. The locking balls have moved radially inward and the lock is now in its unlocked condition and has been longitudinally withdrawn from the front end cap to which it was previously secured.

FIGS. 2–4 show the sequence of unlocking steps produced by movement of the key handle of a key 80 of this invention. In FIG. 2, key 80 is fully inserted through the apertured rear end 28 of the lock barrel 22. Plunger 56 is in its fully forward position against annular shoulder 38 of the barrel 22 and the locking balls 16 are forced radially outwardly to their locking position. In FIG. 2, the key handle is in its first position and the key 80 is actually not causing any movement of the lock.

FIG. 3 shows the key handle rotated to its second position. The lock has not moved at all, but the key has radially expanded to grip the inner surface of the plunger bore 70 in the rear of the lock plunger 56.

FIG. 4 shows the key handle rotated to its final position. The lock plunger 56 has been retracted to its rearward position. At this point, the lock becomes unlocked because the plunger middle exterior portion 60 has cleared the inner apertures of passageways 40 and the locking balls are free to move inwardly in the passageways until they contact the plunger front exterios portion 58.

It will be understood from the drawings that if a prior art key or a pick or a nail is inserted in an improper attempt to unlock barrel lock 14 by retracting the lock plunger 56, the small diameter deterrent ring will usually block entry into the blind bore 70. If the unauthorized device passes through the deterrent ring opening, the deterrent ring will prevent gripping of the inner surface of the blind bore because the unauthorized device will expand and grip and pull only the deterrent ring 44 rearwardly in bore 36. Bottom compression spring 54 will continue to maintain plunger 56 forwardly against shoulder 38. Therefore, middle portion 60 of the plunger 56 will hold locking balls 16 outwardly in their locking position and the lock will remain locked.

FIGS. 1–4 illustrate barrel lock 14 which is designed to be unlocked only by the key of this invention. The key 80 will now be described. FIGS. 2–4 show the key 80 in different operating positions. Key 80 has a hollow cylindrical key barrel 82 with an apertured front end 84 and an open rear end 86 which is closed by an aperture cap 88 (creating an apertured rear end).

Four elongated outer expanding fingers 90 extend longitudinally through apertured front end 84 and are fixed at their rear portions to a centrally apertured sleeve bushing 92 which is mounted for axial movement within the bore of key barrel 82 providing a sliding fit therebetween.

Figure 5:
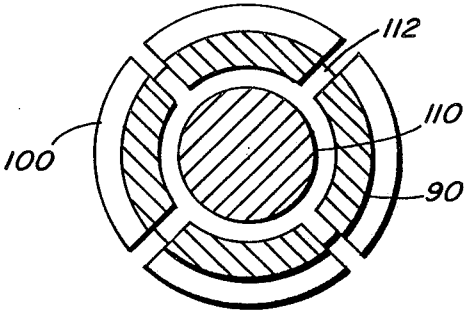
FIG. 5 is a an enlarged cross section showing the four expanding fingers.

A centrally apertured spacer 94 is positioned to the rear of bushing 92 and has an inwardly extending rear rim 96. An outer coil spring 98 is positioned between rear rim 96 and key barrel rear end cap 88 and urges bushing 92 and expanding fingers 90 forwardly. The expanding fingers 90 are formed by taking a hollow cylinder and making four equally spaced-apart longitudinal slits which run rearwardly from the front end of the cylinder about halfway toward the rear end of the cylinder as shown in FIG. 5. The rear end of the cylinder is fixed to bushing 92 and the tips 100 of the expanding fingers 90 are substantially thickened to provide good gripping surfaces. The fingers 90 are radially spreadable and the finger tips 100 are designed to be spread into gripping relationship with the interior surface of the bore 70 in the rear end of the lock plunger 56. However, the fingers 90, the finger tips 100, and the deterrent ring central opening 50 are all sized and shaped so that fingers 90 can be spread and finger tips 100 can grip bore 70 while fingers 90 do not contact deterrent ring 44.

To the rear of bushing 92, a key plunger 102 is coaxially movably mounted within key barrel 82. Key plunger 102 extends rearwardly through apertured rear end cap 88. An inner coil spring 108 is mounted around key plunger 102. The front end of spring 108 bears against the rear surface of a retaining ring 104 which is received in a groove 106 in the front end of plunger 102. The rear end of spring 108 bears against the front surface of end cap 88 and keeps the plunger 102 urged forwardly. Both outer compression spring 98 and inner compression spring 108 are normally in partially compressed states.

A cylindrical expander rod 110 is telescopically and slidably mounted within the center of the outer expanding fingers 90. Expander rod 110 has a frusto-conical front end 112 which has its maximum diameter at the front. The rear end of expander rod 110 is fixed to key plunger 102 and passes through the apertured front end 84 of the barrel 82 and the bushing 92. The length of the expander rod 110 is greater than the length of the expanding fingers 90. A key handle 114 is pivotally attached to the rear end of plunger 102 by a pivot pin 116. Key handle 114 is shaped to be rotated in order to progressively retract key plunger 102 and its associated key parts.

FIG. 2 shows key handle 114 in its first position with plunger 102 in its forward position in contact with bushing 92. Expander rod 110 is in its forward position and the expander rod front end 112 is projected forward of finger tips 100. Thus, finger tips 100 are not spread at all and do not grip the rear bore 70 of lock plunger 56. In the first position, the key 80 has not acted on the lock at all and the lock remains in its locked position.

FIG. 3 shows the key handle 114 rotated to its second position. Plunger 102 has retracted a small distance out of contact with bushing 92. Although plunger 102 has retracted, outer coil spring 98 holds spacer 94 forward which, in turn, holds bushing 92 and expanding fingers 90 forward. On the other hand, the retracting key plunger 102 pulls expander rod 110 rearwardly so that the expander rod frusto-conical front end 112, which has a larger outer diameter than the inner diameter of the expanding fingers 90, is retracted to the same axial position as the finger tips 100 causing the fingers and finger tips to spread apart radially. Outer coil spring 98 maintains continuous forward axial pressure against fingers 90 resisting their retraction, and expander rod 110 generates continuous rearward axial and radial pressures against the interior of the expanding finger tips 100. Consequently, the finger tips 100 spread radially outward without retracting, thereby causing the tips to grip the interior surface of the axial bore 70 in the lock plunger rear end 68 with substantial force.

FIG. 4 shows the key handle 114 rotated to its final position. The key plunger 102 has been retracted to a rearward position. Retaining ring 104, which is fixed to plunger 102, also has been retracted. Expander rod 110, which is fixed to key plunger 102, has been retracted. The expanding fingers 90 have been retracted by rearward movement of expander rod 110. Spacer 94 limits the independent axial movement of expander rod 10 with respect to the axial movement of expanding fingers 90 in order to protect the expanding fingers from being over stressed. The lock plunger 56 has been retracted by the retracting fingers 90. The radial clamping force provided by the expanding fingers 90 is dependent on the axial force transmitted from the outer spring 98 through spacer 94 to bushing 92. Middle portion 60 has been retracted clear of the passageways 40, permitting the locking balls 16 to move radially inward and the lock to become unlocked and to be removed from front end cap 18.

The above description obviously suggests many possible variations from its spirit and scope. It should be understood, therefore, that the invention is not limited in its application to the details of the structure specifically described or illustrated and that, within the scope of the appended claims, it may be practiced otherwise than as specifically described or illustrated.

What is claimed is:

1. A barrel lock and key therefor comprising:

(a) a barrel lock having a hollow cylindrical lock barrel having a closed front end and an apertured rear end, said lock barrel having a stepped axially extending bore, a front bore of said stepped bore having a relatively small diameter and a rear bore of said stepped bore having a relatively large diameter;

(b) said stepped barrel bore having an annular shoulder forming the junction between said front bore and said rear bore;

(c) at least two radially extending passageways running from an outer aperture in the exterior surface of said lock barrel to an inner aperture in said front bore of said lock barrel, and a locking member mounted in each said passageway for limited movement therein, said locking member restrained from completely escaping through said outer aperture;

(d) a cylindrical plunger having a stepped axially extending exterior surface sized and shaped to slidably fit and reciprocate within said stepped bore of said lock barrel, the forward movement of said plunger being limited by said lock barrel annular shoulder, said plunger having a front exterior portion which is sized and shaped to permit said locking members to move radially inward, said plunger having a middle exterior portion which is sized and shaped to prevent said locking members from moving radially inward, said plunger in its rearward position opening the inner aperture of each said passageway and permitting each said locking member to move radially inward to its unlocking position, said plunger in its forward positioin closing the inner aperture of each said passageway forcing each said locking member outwardly to its locking position;

(e) said cylindrical plunger having an open rear end and an axially extending circular blind bore, the interior surface of said blind bore defining a cylindrical gripping surface;

(f) deterrent means for preventing picking of said barrel lock, said deterrent means having a washer-shape which has uniform circular walls forming a central completely circular opening, said deterrent means being positioned within said rear bore of said lock barrel against said rear end of said plunger, the diameter of said completely circular central opening being uniform and being always smaller than the diameter of the cylindrical gripping surface of said circular plunger blind bore;

(g) a top compression spring positioned in said rear bore of said lock barrel, one end of said top compression spring bearing against the rear end of said deterrent means and urging said deterrent means against said plunger;

(h) a bottom compression spring positioned in said rear bore, said bottom compression spring bearing against the forward end of said deterrent means and against said plunger, said bottom compression spring urging said plunger forwardly;

(i) a key adapted to be inserted into said barrel lock and passed through said central circular opening in said deterrent means, said key having a hollow cylindrical key barrel having an apertured front end and an apertured rear end;

(j) a plurality of elongated relatively small diameter outer expanding fingers extending longitudinally forward through said key barrel apertured front end, said outer expanding fingers being fixed at their rear portios to a bushing which is axially movable within said key barrel and which is urged towards said front end of said key barrel, said outer expanding fingers having radially spreadable relatively large diameter gripping surface engaging finger tips;

(k) a key plunger extending longitudinally and rearwardly through said key barrel apertured rear end, said key plunger being axially movable within said key barrel, said key plunger positioned to the rear of said expanding fingers bushing;

(l) a cylindrical expander rod having an enlarged forward head, said expander rod telescopically slidable within said expanding fingers, the length of said expander rod being greater than the length of said expanding fingers, the rear end of said expander rod being fixed to said key plunger; and (m) a key handle pivoted to the rear end of said key plunger, said key handle being manually pivotable to axially reciprocate said key plunger between a forward locked position in which said expander rod head is positioned forward of said expanding finger tips and said expanding finger tips are unspread and have a maximum diameter which is smaller than the uniform diameter of said deterrent means central circular opening, and a rearward unlocked position in which said expander rod is retracted to initially spread said relatively large diameter expanding finger tips to have a maximum diameter which is larger than the uniform diameter of said deterrent means central circular opening, and into firm engagement with said plunger blind bore gripping surface, while maintaining said relatively small diameter outer expanding fingers out of engagement with said deterrent means circular opening walls, and to subsequently pull said fully spread expanding finger tips and said plunger rearwardly permitting said locking members to move to their unlocking positions.

2. The barrel lock and key as claimed in claim 1 wherein said deterrent means is a washer-shaped deterrent ring having a central circular opening.

3. The barrel lock and key as claimed in claim 2 wherein said top compression spring and said bottom compression spring are partially compressed.

4. The barrel lock and key as claimed in claim 3 wherein said plunger has an annular shoulder, and said bottom spring bears against said annular shoulder.

5. The barrel lock and key as claimed in claim 3 wherein each said locking member is a locking ball and said outer aperture of each said passageway has a small inwardly extending rim preventing said locking ball from completely escaping through said outer aperture.

6. The barrel lock and key as claimed in claim 1 wherein said expanding fingers are a portion of a hollow cylinder having a plurality of longitudinally, equally spaced-apart slits, said slits running rearwardly from the front end of said cylinder, said cylinder being fixed at its rear end to said expanding fingers bushing.

7. The barrel lock and key as claimed in claim 6 wherein said key plunger is urged forwardly.

8. The barrel lock and key as claimed in claim 7 wherein an axially positioned outer coil spring urges said expanding fingers bushing forwardly, and a coaxially positioned inner coil spring urges said key plunger forwardly, said inner and outer coil springs acting continuously.

* * * * *